US005332876A

United States Patent [19]

Romano et al.

[11] Patent Number: 5,332,876

[45] Date of Patent: Jul. 26, 1994

[54] ELECTRICAL TILT SWITCH EMPLOYING MULTIPLE CONDUCTIVE SPHERES

[75] Inventors: Robert P. Romano, Glen Ridge; James L. Weaver, Passaic, both of N.J.

[73] Assignee: Comus International, Nutley, N.J.

[21] Appl. No.: 58,902

[22] Filed: May 6, 1993

[51] Int. Cl.[5] ..... H01H 35/02; H01H 35/14

[52] U.S. Cl. ..... 200/61.52; 200/61.45 R; 200/61.83; 200/DIG. 29

[58] Field of Search ..... 200/61.45 R-61.53, 200/61.45 M, 61.83, DIG. 29

[56] References Cited

U.S. PATENT DOCUMENTS

| | | | |
|---|---|---|---|
| 2,107,570 | 2/1938 | Hobbs | 200/61.83 X |
| 2,228,456 | 1/1941 | Hobbs | 200/61.83 X |
| 3,706,867 | 12/1972 | Rand et al. | 200/61.52 |
| 3,840,088 | 10/1974 | Marumo et al. | 200/61.45 M X |
| 3,955,356 | 5/1976 | LeCocq | 200/61.52 X |
| 4,450,326 | 5/1984 | Ledger | 200/61.45 M |
| 4,467,154 | 8/1984 | Hill | 200/61.45 R |
| 4,628,160 | 12/1986 | Canevari | 200/61.45 R |
| 4,857,680 | 8/1989 | Janotik | 200/61.45 R |
| 4,943,690 | 7/1990 | Bitko | 200/61.47 |
| 5,010,893 | 4/1991 | Sholder | 200/61.52 X |
| 5,164,556 | 11/1992 | Yoshimura et al. | 200/61.45 M |
| 5,168,138 | 12/1992 | Evans | 200/61.52 |
| 5,209,343 | 5/1993 | Romano et al. | 200/61.52 |

*Primary Examiner*—J. R. Scott
*Attorney, Agent, or Firm*—Plevy & Associates

[57] ABSTRACT

The present invention is a tilt switch that opens or closes an electrical circuit in accordance with the angle of inclination of the switch. The present invention switch includes a housing that defines a hollow cavity. A first sphere, having a highly conductive circumferential surface, is positioned within the hollow cavity. As the switch is inclined, the first sphere rolls to one end of the housing where the sphere contacts an electrical connector. The first sphere electrically interconnects the electrical connector to the housing on which the sphere rests, thereby completing an electrical connection between the electrical connector and the conductive material of the housing. At least one second sphere is also positioned within the housing. The second sphere is sized in relation to the hollow cavity so that the first sphere cannot pass by the second sphere within the cavity. As the switch is inclined, the first sphere rolls against the electrical connector, closing the switch. The second sphere rolls against the first sphere, biasing the first sphere against the electrical connector and creating a more reliable switch. Since the second sphere itself does not engage the electrical connector, the second sphere can be fabricated from any desired heavy material, such as lead or tungsten, which allows the switch to be easily and inexpensively manufactured.

14 Claims, 3 Drawing Sheets

ELECTRICAL TILT SWITCH EMPLOYING MULTIPLE CONDUCTIVE SPHERES

FIELD OF THE INVENTION

The present invention relates to tilt switches and more particularly to such switches that utilize a plurality of free moving weights enclosed within a housing to activate or deactivate the switch as a function of the angle of inclination of the switch.

BACKGROUND OF THE INVENTION

Electrical tilt switches and like devices operate to switch electrical circuits either ON or OFF as a function of the angle of inclination of the switch. See, for example, U.S. patent application Ser. No. 07/822,641 filed Jan. 21, 1992 now U.S. Pat. No. 5,209,343 by Robert P. Romano, et al. and entitled "ELECTRICAL TILT SWITCH" and assigned to the assignee herein. This application discloses various switch configurations which can be employed with the present invention. Such switches normally include a free moving electrically conductive element that contacts at least two terminals when the conductive element is biased to an operating position by gravity. A well known form of the electrical tilt switch is the mercury switch. In a typical mercury switch, a glob of mercury moves freely within a housing. As the housing is inclined, gravity pulls the glob of mercury to one end of the housing where it completes an electrical circuit.

Mercury tilt switches are fairly easy to manufacture, however, due to environmental concerns, it is becoming increasingly difficult to manufacture any product that includes mercury. Mercury is a highly toxic substance. As such, there exists a large number of federal, state and local guidelines controlling the use, storage and disposal of mercury. The increase in governmental regulation has increased the cost of manufacturing mercury switches to a point where alternative non-mercury tilt switches have become more competitive.

When manufacturing a tilt switch without mercury, a substitute free moving conductive element must be used. A common substitute is a single metal ball. Tilt switches utilizing metal balls in place of globs of mercury are exemplified in U.S. Pat. Nos. 4,628,160 to Canevari; 4,467,154 to Hill; 4,450,326 to Ledger; and 3,706,867 to Raud; et al. The use of a metal ball to complete an electric circuit is a simple and inexpensive way to create a tilt switch. However, metal balls do have certain inherent disadvantages. A metal ball contacts a flat surface only along its tangent. Consequently, in many prior art switches that use flat contact points, only a small area of the metal ball is in actual electrically conductive contact within the switch. Adversely, with mercury switches, the mercury glob would envelope a terminal as it contacted it, resulting in a large surface area through which electricity could be conducted. The comparatively small surface area of a metal ball, through which electricity can be conducted, has made metal ball tilt switches generally less reliable than mercury switches.

Another disadvantage of conventional metal ball tilt switches is that when a metal ball does contact a terminal, the resulting electrical coupling across the contact area is poor. In a mercury switch, the mercury glob would flow into any pit or void it encountered on a terminal, creating a good electrical coupling. However, with conventional metal ball tilt switches, the metal ball is unable to conduct electricity across any pits or voids that exist on either the surface of the terminal or the metal ball itself. Since electricity passes through the metal ball from the terminal it is contacting, arcing can occur across any void in the contact surface. The arching may cause pitting or corrosion on both the metal ball and the terminal, reducing the conductivity of both surfaces.

In an attempt to improve the functional reliability of metal ball tilt switches, switches have been created that use multiple balls. By using multiple balls the points of contact between the balls and the terminals is increased, thereby increasing the reliability of the switch. Furthermore, by using multiple balls within a switch, the forward lying balls are pressed against the terminal contacts of the switch, by the weight of the rearward balls. The bias provided to the forward balls by the rearward balls create an improved electrical coupling of the forward balls with the switch terminals, thereby increasing the overall reliability of the switch. Prior art switches that utilize multiple metal balls are exemplified by U.S. Pat. No. 2,107,570 to Hobbs and U.S. Pat. No. 2,228,456 to Hobbs.

A disadvantage of many prior art tilt switch that use multiple balls, is that one never knows which ball or balls with actually contact the terminals within the switch. Consequently, each of the balls must be manufactured to be highly conductive and corrosive resistant so as to provide a proper electrical contact. Manufacturing a multitude of such conductive and corrosive resistent balls adds greatly to the cost of such prior art tilt switches. Another disadvantage of some switches that utilize multiple balls is that the switches are highly sensitive to vibrations. As a switch with multiple balls experiences vibrations, the position of the multiple balls within the switch may change as the various balls roll over each other or reorient themselves to the forces of gravity. Such movements of the balls may cause slight changes in the overall impedance and resistance of the switch, thereby making the switch a poor choice for use with sensitive circuitry. Furthermore, as a tilt switch is inclined, the metal balls roll toward the terminals within the switch. However, as the balls strike the terminals, the balls may bounce a slight distance away from the terminal. Consequently, the contact of the ball bouncing against a terminal produces a short pulsed signal that can adversely effect some sensitive circuitry.

It is therefore an objective of the present invention to provide a more reliable tilt switch that utilizes a plurality of ball contacts, wherein only one ball contact is of precision manufacture, thereby reducing the cost of producing the tilt switch.

It is yet another object of the present invention to create a more reliable tilt switch that is list susceptible to creating false or changing signals that can adversely effect sensitive circuitry.

SUMMARY OF THE INVENTION

The present invention is a tilt switch that opens or closes an electrical circuit in accordance with the angle of inclination of the switch. The present invention switch includes a housing that defines a hollow activity. A first sphere, having a highly conductive circumferential surface, is positioned within the hollow cavity. As the switch is inclined, the first sphere rolls to one end of the housing where the sphere contacts an electrical connector. The first sphere electrically interconnects the electrical connector to the housing on which the sphere rests, thereby completing an electrical connection between the electrical connector and the conductive material of the housing. At least one second sphere is also positioned within the housing. The second sphere is sized in relation to the hollow cavity so that the first sphere cannot pass by the second sphere within the cavity. As the switch is inclined, the first sphere rolls against the electrical connector, closing the switch. The second sphere rolls against the first sphere, biasing the first sphere against the electrical connector and creating a more reliable electrical connection. Since the second sphere itself does not engage the electrical connector, the second sphere can be fabricated from any desired heavy material, such as lead or tungsten, which allows the switch to be easily and inexpensively manufactured.

In a preferred embodiment, the electrical connector engages the first sphere at a position above the center of the first sphere, as the first sphere rolls against the electrical connector. By engaging the first sphere off-center, the first sphere is less prone to bounce away from the electrical connector as the sphere engages the electrical connector. Furthermore, the presence of the second sphere behind the first sphere prevents the first sphere from bouncing away from the electrical connector, since any rebound energy is transferred through the first sphere into the second sphere. Consequently, the second sphere may temporarily bounce away from the first sphere, but the first sphere remains set in place against the electrical connector. The high quality of the conductive surface of the first sphere, coupled with the bias supplied by the second sphere combine to provide a tilt switch that is more reliable and has improved performance characteristics over many prior art metal ball tilt switches.

BRIEF DESCRIPTION OF THE FIGURES

For a better understanding of the present invention, reference is made to the following description of two exemplary embodiments thereof, considered in conjunction with the accompanying drawings, in which.

DETAILED DESCRIPTION OF THE DRAWINGS

Figure 1:
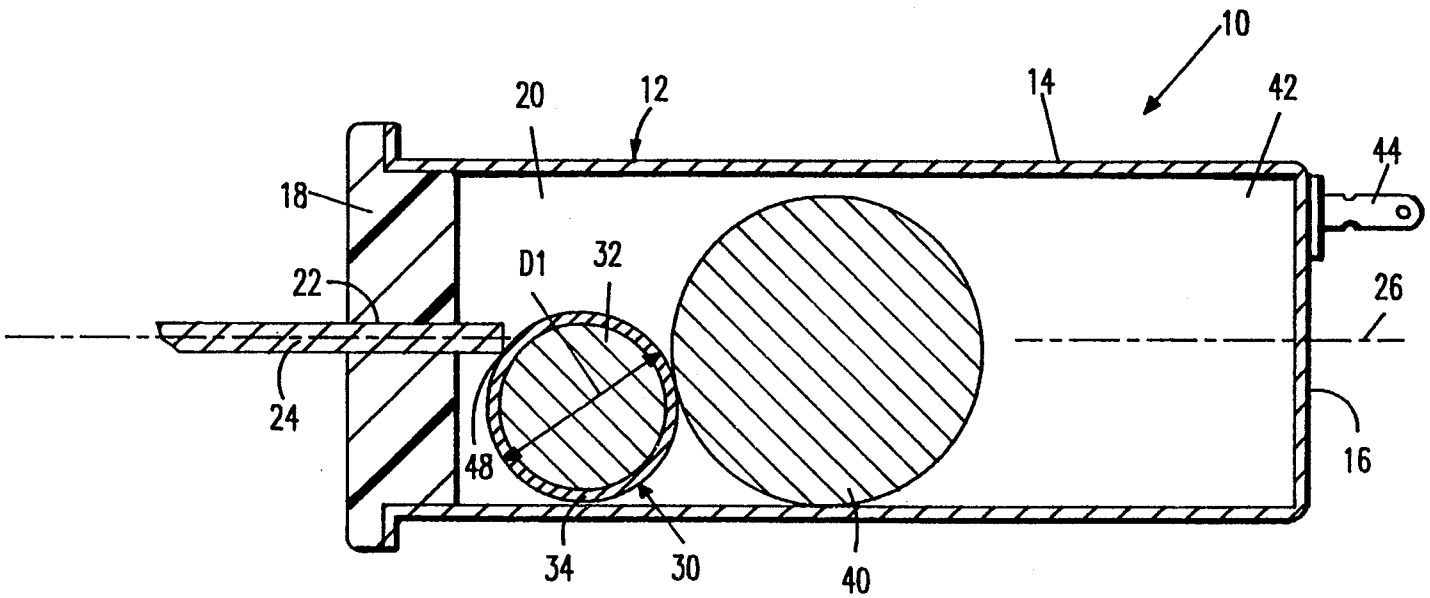
FIG. 1 is a side cross-sectional view of an electric tilt switch constructed in accordance with one exemplary embodiment of the present invention.

Referring to FIG. 1, a tilt switch 10 is shown. The tilt switch 10 is comprised of an electrically conductive housing 12 that is cup-shaped having a substantially tubular jacket 14 and one closed end 16. The housing 12 may be unistructural, as is shown, or the tubular jacket 14 and the closed end 16 may be separate components joined in an air tight manner. The open end of the housing 12 is covered by a dielectric end cap member 18. The end cap member 18 is joined to the housing 12 forming a gas impervious seal; thus creating a hollow cavity 20 within the housing 12 that is isolated from the surrounding environment. An aperture 22 is formed through the end cap member 18, through which an electrical connector 24 is placed. The aperture 22 is centrally positioned through the center end cap member 18, thereby enabling the electrical connector 24 to extend into the hollow cavity 20, along the central axis 26 of the tubular jacket 14.

A small ball 30 is positioned within the housing 12. The small ball 30 has a highly conductive circumferential surface and is preferably fabricated from an inner core 32 of highly dense material, such as lead or tungsten, that has a highly conductive outer plating 34 such as platinum, copper, nickel or gold. The diameter D1 of the small ball 30 is only slightly larger than half the inside diameter of the tubular jacket 14 of the housing. As such, when the small ball 30 is biased against the electrical connector 24 by gravity, the electrical connector 24 contacts the small ball 30 along its upper hemisphere for a purpose which will be later described.

At least one large ball 40 is positioned within the housing 12 on the side of the small ball 30 opposite the electrical connector 24. The large ball 40 is sized in proportion to the small ball 30 and the housing 12, such that the small ball 30 cannot pass the large ball 40 within the confines of the housing 12. The large ball 40 is made of a dense, inexpensive material such as lead, tungsten or the like and does not have any outer plating of another metal.

The hollow cavity 20 isolated within the housing 12 is filled with an inert gas 42 such as nitrogen, neon or the like. The inert gas 42 provides a non-corrosive environment for the small ball 30, preventing oxidation, pitting and other corrosion common to electrical contacts. It should be understood that although the presence of an inert gas 42 is preferred, a non-corrosive environment can be formed within the housing 12 by evacuating the housing 12 of all gases or filling the housing with a low viscosity, non-conductive liquid such as silicon oil.

A terminal 44 is connected to the housing 12. The terminal 44 couples the housing 12 to a source of electrical potential (now shown). The electrical connector 24 extends through the end cap member 18 and is coupled to an opposing source of electrical potential (not shown). The electrical connector 24 is electrically insulated from the housing 12 by the presence of the dielectric end cap member 18, thus an open circuit exists between the housing 12 and the electrical connector 24.

In operation, the small ball 30 and large ball 40 are both free moving within the housing 12. Consequently, as the housing 12 is inclined toward the closed end 16 of the housing 12, the large ball 40 rolls against the closed end 16 and the small ball 30 rolls against the large ball 40. Consequently, no electrical connection exists between the housing 12 and the electrical connector 24. When the housing 12 is inclined such that gravity pulls the small conductive ball 30 and the large conductive ball 40 in the direction of the electrical connector 24, the small ball 30 rolls against the electrical connector 24, and the large ball 40 rolls against the small ball 30, thereby biasing the small ball 30 against the electrical connector 24. Consequently, as the small ball 30 impacts the electrical connector 24, any rebounding force from the impact is transferred through the small ball 30, into the large ball 40. As such, the large ball 40 may temporarily bounce away from the small ball 30, but the small ball 30 remains in place and in contact with the electrical connector 24, thereby eliminating any temporary disruption in the connection caused by a rebounding bounce after contact.

The rebounding of the small ball 30 against the electrical connector 24 is further reduced by the physical characteristics of both the electrical connector 24 and the small ball 30. In the shown embodiment, the electrical connector 24 is a cylindrical rod that terminates within the hollow cavity 20 of the housing 12. As the housing 12 is inclined and the small ball 30 is biased against the electrical connector 24, the electrical connector 24 does not contact the small ball 30 along its horizontal equator. Rather, the corner edge 48 of the electrical connector 24 contacts the small ball 30 along the curvature of the upper hemisphere of the small ball 30. Consequently, when the small ball 30 impacts the electrical connector 24, the resulting rebounding force has only a small horizontal component that tries to drive the small ball 30 away from the electrical connector 24.

When the small ball 30 is in contact with the electrical connector 24, the small ball 30 is biased against the electrical connector 24 by the weight of the large ball 40. The bias exerted by the large ball 40 causes a highly reliable point of electrical contact to occur between the corner edge 48 of the electrical connector 24 and the small ball 30. Consequently, a stable electrical connection is made from the electrical connector 24, through the outer plating 34 of the small ball 30, through the conductive housing 12 and to the terminal 44. A secondary electrical connection is made between the electrical connector 24 and the terminal 44, by the flow of electricity through the outer plating 34 of the small ball 30 and through the conductive material of the large ball 40 to the conductive material of the housing 12. It will be understood that in the shown embodiment, the small ball 30 is plated with highly conductive material to minimize the cost of manufacturing the small ball 30. However, the small ball 30 can be uniformly fabricated from a highly conductive material and therefore need not contain an outer plating layer of conductive material.

In the shown embodiment, when inclined, the small ball 30 is held firmly against the electrical connector 24 by the geometries of the housing 12 and the large ball 40. More specifically, the small ball 30 is prevented from moving toward the dielectric end cap member 18 by the contact with the electrical connector 24. Similarly, the small ball 30 is prevented from moving toward the closed end 16 of the housing 12 by the bias exerted by the large ball 40. The small ball 30 is prevented from moving up and down within the housing by the contact of both the electrical connector 24 and the large ball 40.

Figure 2:
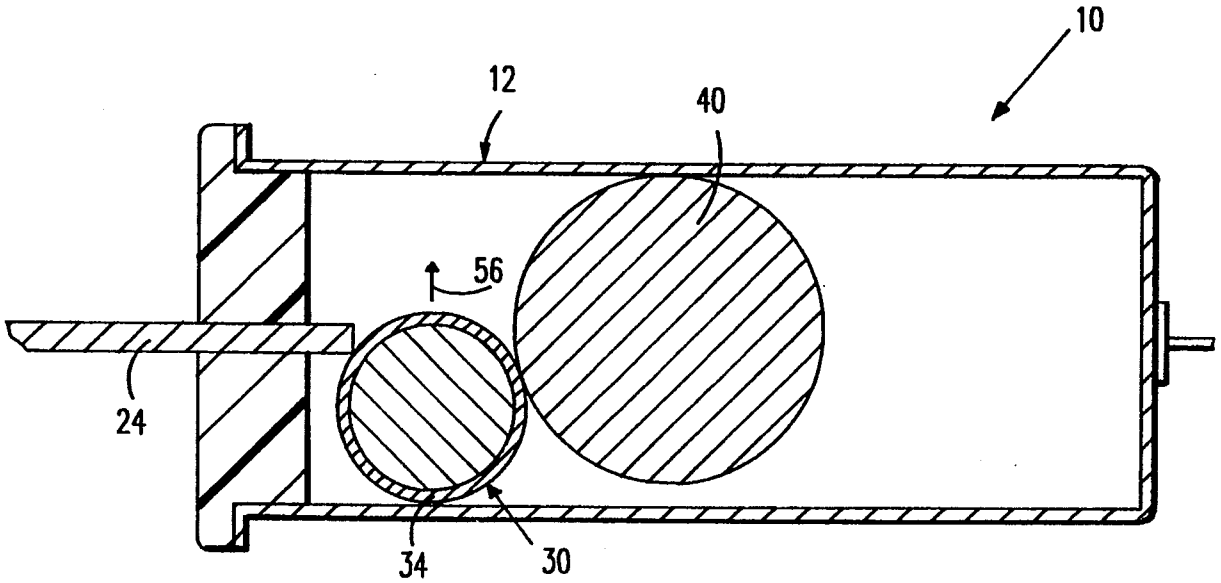
FIG. 2 is a top cross-sectional view of the embodiment of FIG. 1.

Referring to the top view shown in FIG. 2 in conjunction with FIG. 1, it can be seen that the small ball 30 is prevented from moving sideways in the direction of arrow 56 by the contact of both the electrical connector 24 and the large ball 40 against the small ball 30. Since the small ball 30 is prevented from moving either up and down or sideways by the contact of the electrical connector 24 and large ball 40, when the small ball 30 is biased against the electrical connector 24, the small ball 30 becomes trapped into a set position and is unable to move until the bias exerted by the large ball 40 is removed. Consequently, the small ball 30 remains firmly in contact with both electrical connector 24 and the housing 12 as the overall tilt switch 10 experiences various vibrations or minor manipulations. As such, the present invention tilt switch 10, is more reliable and resistant to vibrations than prior art switches where the ball weights are not biased into a single set position.

Figure 3:
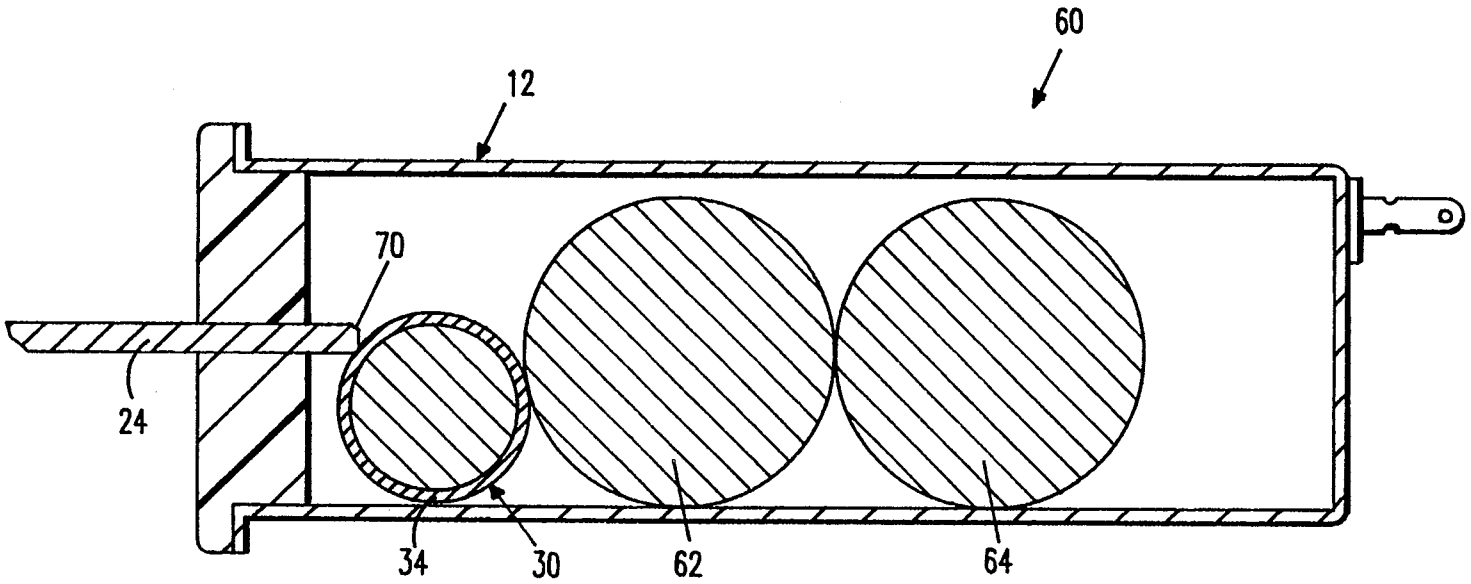
FIG. 3 is a cross-section view of an electric tilt switch constructed in accordance with a second exemplary embodiment of the present invention.

Referring to FIG. 3, an alternative embodiment of the present invention tilt switch 60. The various elements of the tilt switch 60 that correspond in form and function to the elements previously described in regard to FIGS. 1 and 2 will be referenced with the same nomenclature as was used in FIGS. 1 and 2. In FIG. 3, a single small ball 30 is positioned within the hollow cavity 20 of the housing 12 along with a plurality of large balls 62, 64. The small ball 30 has a highly conductive outer surface 34, as has been previously described. Each of the large balls 62, 64 is made of a dense material, that may, or may not, be highly conductive. With two large balls 62, 64 present within the housing 12, the bias exerted against the small ball 30 is doubled when the housing 12 is appropriately inclined. Consequently, the quality of the electrical contact between the electrical connector 24 and the small ball 30 is increased. Similarly, the switch's overall sensitivity to vibrations and small manipulations is further decreased.

In the shown alternate embodiment, the conductive member 24 terminates at an end 70 that is contoured to match the curvature of the small ball 30. As such, the area of contact between the small ball 30 and the electrical connector 24 is increased, thereby adding to the overall reliability of the switch 60. Since the electrical connector 24 does not have a sharp edge that contacts the small ball 30, the possibility that the electrical connector 24 may eventually damage the conductor surface 34 on the small ball 30 is reduced. Therefore, the overall life span and reliability of the switch 60 is increased.

It will be understood that the present invention tilt switch devices described herein are merely exemplary and that a person skilled in the art may make many variations and modifications to the described embodiment utilizing functionally equivalent components to those described. As such, variations and modifications, including differing physical geometrics, proportions and materials are intended to be included within the scope of the invention as defined in the appended claims.

What is claimed is:

1. A tilt switch for opening or closing an electric circuit in accordance with the angle of inclination of said switch, comprising:

a housing means having a hollow cavity disposed therein;

a first free moving weight, having a core fabricated from a dense material with a conductive circumferential surface, positioned within said cavity, said first free moving weight moving to an operating position within said cavity when said first free moving weight is biased by gravity to said operating position by the angle of inclination of said housing means;

at least one second free moving weight, fabricated from said dense material, positioned within said cavity and sized in proportion to said cavity so that said first free moving weight cannot pass said at least one second free moving weight within said cavity, said at least one second free moving weight biasing said first free moving weight into said operating position when said at least one second free moving weight is biased toward said operating position by gravity; and a terminal means disposed at said operating position, said first free moving weight contacting and electrically coupling with said terminal means when said first free moving weight is at said operating position.

2. The tilt switch according to claim 1, further including an inert atmosphere within said cavity, said inert atmosphere detering the corrosion of said conductive circumferential surface on said first free moving weight, and said housing means further including an end cap member which is adapted to form a gas impervious seal with said housing means to prevent the escape of said inert atmosphere from said cavity.

3. The tilt switch according to claim 2, wherein said inert atmosphere is a vacuum.

4. The tilt switch according to claim 1, wherein said first free moving weight is a first sphere having a conductive circumferential surface.

5. The tilt switch according to claim 4, wherein said core material of said first sphere is selected from a group consisting of lead or tungsten and said first sphere including a highly conductive circumferential coating.

6. The tilt switch according to claim 5, wherein said highly conductive circumferential coating is selected from a group consisting of platinum, gold, copper or nickel.

7. The tilt switch according to claim 4, wherein said at least one second free moving weight includes a second sphere.

8. The tilt switch according to claim 7, wherein a plurality of second spheres are disposed within said housing.

9. The tilt switch according to claim 7, wherein said at least one second sphere engages said first sphere when said first sphere is at said operating position thereby biasing said first sphere against said terminal means when at said operating position.

10. The tilt switch according to claim 7, wherein said housing means includes a substantially tubular member made of a conductive material, said tubular member including at least one end having said terminal means extending there through, said terminal means including a conductive connector, wherein said conductive connector is electrically insulated from said tubular member, and wherein said first sphere contacts and electrically interconnects both said tubular member and said conductive connector when said first sphere is at said operating position.

11. The tilt switch according to claim 10, wherein said conductive connector is contoured to engage said first sphere, when said first sphere is at said operating position, in such a manner so as not to adversely effect said conductive circumferential surface on said first sphere.

12. The tilt switch according to claim 10, wherein said conductive connector contacts said first sphere above the center of said first sphere when said first sphere is at said operating position, thereby reducing the tendency of said first sphere from bouncing away from said conductive connector when said first sphere contacts said conductive connector.

13. The tilt switch according to claim 12, wherein said hollow cavity is cylindrical having an inner diameter, said conductive connector is centrally disposed through said at least one end of said housing, and said first sphere has a diameter slightly greater than half of said inner diameter whereby said conductive connector contacts said first sphere at a point above its center when said first sphere is at said operating position.

14. The tilt switch according to claim 13, wherein said second sphere has a diameter slightly less than said inner diameter of said cavity.

* * * * *